US006085956A

United States Patent [19]

Sainio et al.

[11] Patent Number: 6,085,956

[45] Date of Patent: Jul. 11, 2000

[54] METHOD AND APPARATUS FOR CONTROLLING TENSION IN A WEB OFFSET PRINTING PRESS

[75] Inventors: Jeffrey W. Sainio, Milwaukee; Timothy J. Pulte, West Bend, both of Wis.

[73] Assignee: Quad/Graphics, Inc., Sussex, Wis.

[21] Appl. No.: 09/128,764

[22] Filed: Aug. 4, 1998

[51] Int. Cl.[7] ..... B65H 23/18; B41F 13/54

[52] U.S. Cl. ..... 226/4; 101/228; 226/42; 226/108; 242/418

[58] Field of Search ..... 226/4, 42, 44, 226/108; 242/418

[56] References Cited

U.S. PATENT DOCUMENTS

| | | | |
|---|---|---|---|
| 3,032,245 | 5/1962 | George et al. | 226/39 |
| 3,556,510 | 1/1971 | Treff | 270/52 |
| 3,613,975 | 10/1971 | Knight | 226/25 |
| 3,645,430 | 2/1972 | Lagain | 226/44 X |
| 3,667,664 | 6/1972 | Schroeder | 226/30 |
| 3,694,634 | 9/1972 | Horst et al. | 226/42 X |
| 3,724,733 | 4/1973 | Schaffer et al. | 226/25 |
| 3,784,123 | 1/1974 | Lewis . | |
| 3,807,613 | 4/1974 | Holm | 226/42 |
| 3,913,900 | 10/1975 | Muster et al. | 226/44 |
| 4,359,178 | 11/1982 | Hayashi et al. | 226/44 X |
| 4,452,140 | 6/1984 | Isherwood et al. | 101/181 |
| 4,722,275 | 2/1988 | Taguchi et al. | 101/228 |
| 4,958,111 | 9/1990 | Gago | 318/6 |
| 5,219,109 | 6/1993 | Shirono | 226/4 X |
| 5,269,222 | 12/1993 | Johnson et al. | 101/228 |
| 5,318,796 | 6/1994 | Torpey et al. | 226/44 X |
| 5,377,891 | 1/1995 | Peltzer et al. | 226/24 |
| 5,480,085 | 1/1996 | Smithe et al. | 226/44 |
| 5,485,386 | 1/1996 | Andreasson | 364/471 |
| 5,602,747 | 2/1997 | Rajala | 364/469.01 |
| 5,657,941 | 8/1997 | Simons et al. | 242/420.6 |
| 5,894,797 | 4/1999 | Brennan et al. | 226/42 X |

*Primary Examiner*—Michael R. Mansen
*Attorney, Agent, or Firm*—Michael Best & Friedrich LLP

[57] ABSTRACT

The inertial drag of idler rollers in a web-offset press with independently driven drive rollers is compensated by successively advancing downstream rollers during speed changes. This prevents low-tension conditions on the web and subsequent web breaks. Compensation is made for inertial coupling to the idler rollers through the web. Tension control is utilized to stabilize web position during startups and splices.

24 Claims, 9 Drawing Sheets

METHOD AND APPARATUS FOR CONTROLLING TENSION IN A WEB OFFSET PRINTING PRESS

MICROFICHE APPENDIX

The computer program referenced in the present invention is included in a microfiche appendix which includes one microfiche and is on a total of 34 frames.

FIELD OF THE INVENTION

The present invention relates generally to the control of driven rollers in a web-offset printing press. More particularly, the invention relates to a method and apparatus for controlling tension in a web-offset printing press which prevents degraded product and web-breaks.

BACKGROUND OF THE INVENTION

A web-offset printing press line may include a plurality of various components or modules operating on a substrate or web, typically paper. These components may include printing units, a chill stand including chill rolls, numbering units, gluers, slitters, and/or folders, as well as others. Independently driven motors drive rollers in the different modules of the press to drive the web along the press line.

Tension of the web is controlled by the use of gain. In other words, the rollers driving the web are operated at a slightly higher surface speed than the web. Generally, successive rollers downstream are operated at successively higher gain, so that tension is maintained between the driven points. The rollers are operated at gains which also compensate for the various treatments performed on the web: for instance, dryers will heat and expand the web, and chill rolls will cool and shrink the web. Gain is generally created through the use of harmonic gearboxes, as disclosed in U.S. Pat. No. 3,724,733, or by drag gearboxes, as disclosed in U.S. Pat. No. 5,269,222. The required gain is generally determined by the press speed, tension, operator input, or a combination thereof, and is typically on the order of two to five parts per thousand.

Excessive gain will cause the web to stretch, then slip. Because holding friction is greater than slipping friction, this tends to cause an oscillation. A so-called grip-and-slip action occurs where the web is pulled tighter and tighter until slippage occurs. Such oscillation is undesirable during normal press running operation, because the cutoff of the resultant printed product will similarly oscillate. During speed changes, however, product is usually not savable for other reasons, so larger gains during speed changes are often not a disadvantage. As a general rule, high tension, up to two times normal tension, will cause only paper wastage. However, low tension is also problematic, causing web-breaks and press stoppage. Press stoppage causes considerable delay and paper wastage upon re-start.

In the manufacture of large web-offset printing presses, one trend is to replace the lineshaft, which drives the various components of the press, with independent drive motors for each component. The various components, such as chill rolls, numbering units, gluers, slitters, and folders, can then be independently added to the press in a modular fashion. The mechanical gearboxes are replaced by software such that the motors driving the components are commanded to rotate at slightly higher speeds than the web, thereby achieving the required gain.

The programming of the independent motor drives on the press has emulated the operation of their predecessor, the lineshaft. Motors in such independently driven or "shaftless" presses are programmed to operate in synchrony with the printing units, with an operator-adjustable degree of gain. This gain is typically two to five parts per thousand.

The modular nature of shaftless presses also tends to require more idler rollers in the web path. The various components, often from different manufacturers, will typically accept a web at a standardized height and also output the web at a standardized height. A standardized height for the various components means that the web path is not optimized, requiring more idler rollers in the web path.

The idler rollers contribute to the inertia that must be overcome by the web during speed changes. For a large enough speed change and a large number of idler rollers, a web span may exhibit normal tension at one end of the span, yet be slack at the other end. A slack web generally causes excessive web breaks. For example, a slack web at a slitter will merely wrap around the slitter blade rather than be cut, causing tearing and web breaks. As another example, a slack web in a folder may move off-center laterally, causing jams during folding. Further, a slack web during a web acceleration at a chill roll may cause the web in the dryer to be sucked toward the dryer exhaust ports. The lateral shift of the web may be so extreme as to be beyond the ability of a web guide to correct, causing jam-ups and press stoppage. Web tension along a span may be substantially different than what is measured at a transducer at a single point in the span.

The drag of idler rollers on an accelerating web can also cause the position of the web to retard behind the position normally expected. This causes a cutoff error in downstream cutting equipment which results in improperly cut material that is unacceptable, increasing wastage.

A further complication of the idler rollers relates to the inertia reflected back to the drive motors. If the web is slack, no motor motion is transmitted to the idler rollers. If the web is tight, the idler rollers in the path of the web are seen by the drive motors as an inertial load. A drive motor that is programmed to react to a large inertial load will overreact and oscillate or chatter when the load is removed. Because this oscillation is undesirable, the drive motors are adjusted to react to the minimum inertial load. Under normal press running conditions, this inertial setting is inadequate, causing sluggish reaction time and inadequate tension control.

One method to reduce the effects of idler roller inertia is to utilize lightweight rollers such as Valcom (TM) carbon composite rollers available from American Roller Company of Bannockburn, Ill. These rollers are typically one-third the weight of similar aluminum rollers, but are twice the cost.

With rising postal rates and paper costs, publishers are utilizing lighter weight paper stock as a substrate for magazines and catalogs. This paper is more prone to wrinkling, particularly on press startup. Wrinkles may directly initiate a tear of the web with subsequent press stoppage. Wrinkles may also interact with the slitter to initiate a tear near the slitter.

Additionally, when a new roll of paper is spliced into the running web, the new paper is pulled more forcefully by the upper folder rollers of the press, resulting in a typical ten to thirty percent increase in tension. This tension increase decays logarithmically to nominal tension with a half-life on the order of about thirty seconds. Uncorrected, this tension increase causes an undesirable advancement of the cutoff of the resultant printed product. The cutoff disruption is particularly large on the upper web of a double-web press. A system to compensate for this tension disturbance is disclosed in U.S. Pat. No. 4,452,140. However, the disclosed system requires additional compensator stations, which may be difficult to retrofit onto a press.

SUMMARY OF THE INVENTION

It is an object of the present invention to provide a method and apparatus for controlling driven rollers in the web path of a web-offset press to compensate for roller inertia, and prevent slack web. It is a further object of the present invention to prevent excess cutoff error during changes in press speed. Another object of the invention is to control motor drive inertial response, so that quick response is taken to tension upsets while running, without overreaction or chatter at low tension. A still further object of the invention is to achieve proper tension on startup, while maintaining proper cutoff during normal operation. Another object of the invention is to compensate for tension upsets subsequent to splices, minimizing cutoff error and paper waste.

BRIEF DESCRIPTION OF THE DRAWINGS

FIG. 1(*b*) is a front view of the printing press line of FIG. 1(*a*) and better illustrating the folder;

Figure 1A:
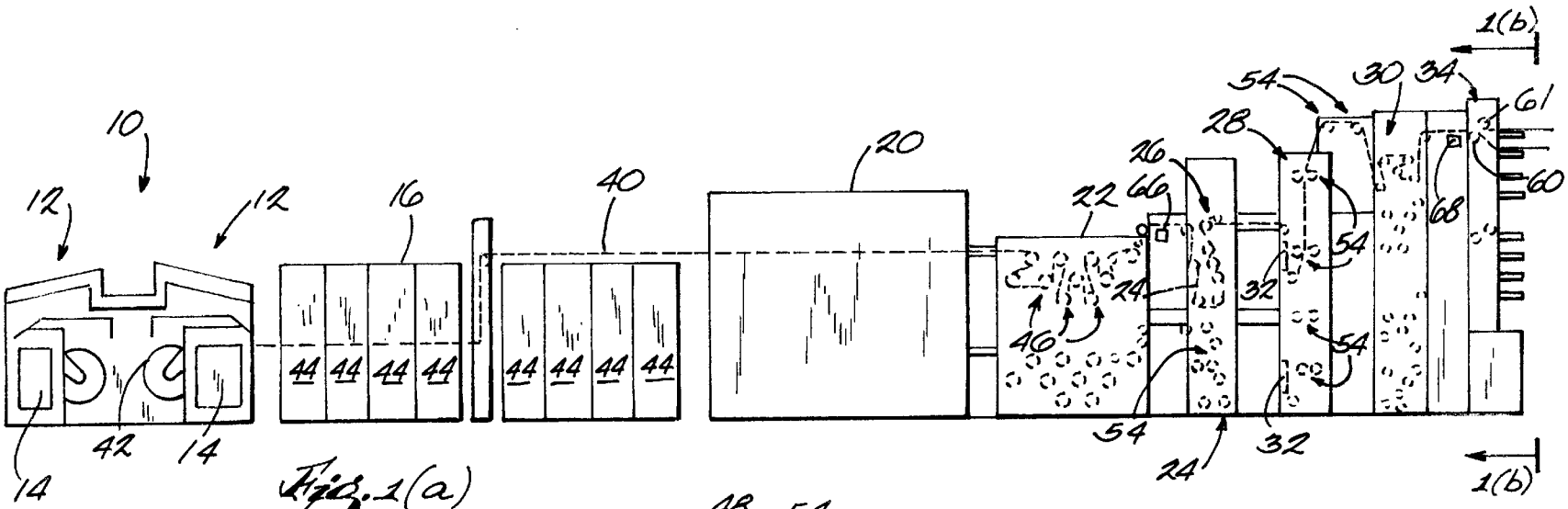
FIG. 1(*a*) is a schematic diagram of a conventional independently-driven web-offset printing press line.

Before one embodiment of the invention is explained in detail, it is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DESCRIPTION OF THE PREFERRED EMBODIMENT

Figure 1B:
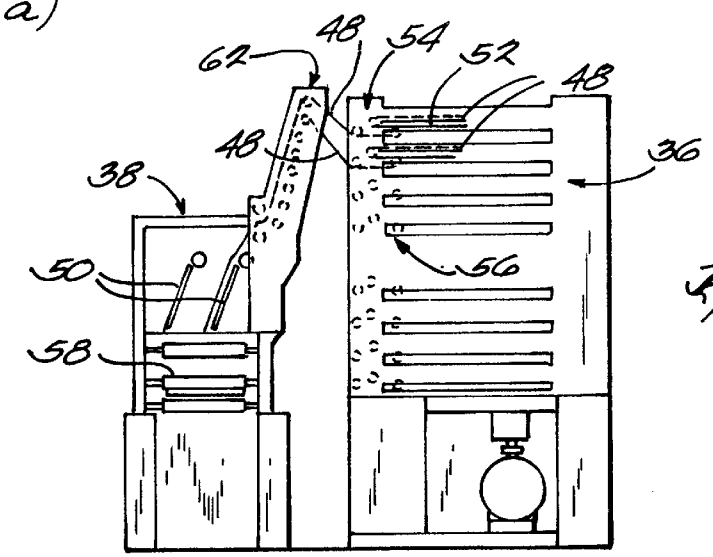

Illustrated in FIGS. 1(*a*) and 1(*b*) is a conventional web-offset printing press line 10. An example of such a press is a Heidelberg-Harris M3000. In the illustrated embodiment, the printing press line 10 includes various modules such as a web splicing unit 12, infeed web guides 14, printing press 16, dryer 20, chill stand 22, web guides 24, color registration unit 26, numbering units 28, full web compensators 30, silicone coating units 32, slitter 34, ribbon deck 36 and folder 38. The modular nature of the printing system allows the various modules to be added or omitted as desired. The embodiment illustrated is capable of running either a single web or two webs at one time.

In particular, when running a single web 40, the web 40 (typically paper) is fed from a reel stand 42 through the infeed web guide 14 to the printing press 16. The web splicing unit 12 is operable to splice a new roll of paper to the end of a previous roll, typically while the web is moving through printing press line 10.

The printing press 16 comprises a plurality of serially disposed conventional printing units 44. In a web-offset printing press operable to print on both sides of the web, each of the printing units 44 includes an upper blanket cylinder, an upper plate cylinder, a lower blanket cylinder, and a lower plate cylinder (none of which are shown), as is well known in the art. The printing units 44 cooperate to imprint multi-color images on the upper and lower surfaces of the web 40. Each printing unit 44 prints an associated color of ink; typically the first printing unit prints the color black, and subsequent units print the colors cyan, magenta, and yellow, as is known in the art. In the system shown, there are eight printing units so that two webs can each be run through four printing units at the same time.

The web is subsequently routed through the dryer 20, then the chill stand 22, to another web guide 24, and then to color registration unit 26, optional numbering unit 28, silicone coating unit 32, and full web compensator 30. The dryer 20 heats the web 40 to evaporate various solvents in the ink. The chill stand 22 consists of a set of hollow chill rolls 46 which are filled with a chilled water solution and operate to quickly cool the web 40 after the drying step to set the ink. The web guide 24 operates to laterally position the web 40 fed to the slitter 34. The color registration unit 26 is employed to register (align) the respective images generated by each of the individual printing units. The coating unit 32 applies a silicone coating to the web 40. The numbering unit 28 operates to apply sequential numbering to the printed images. The full web compensator 30 includes a roller movable to adjust the longitudinal web path. The slitter 34 operates to slit the web 40 longitudinally (substantially parallel to the direction of web motion) into two or more ribbons 48.

Referring specifically to FIG. 1(*b*), after exiting the slitter 34, the ribbons 48 are turned by ninety degrees by the ribbon deck 36, and are aligned one on top of the other. The stacked ribbons 48 are then fed to the former board 50 of the folder 38 which operates to fold the ribbons longitudinally. The folder 38 includes various positioning mechanisms such as angle bars 52, idler rollers 54, and compensators 56, as is well known in the art. For example, the angle bars 52 operate to change the direction of motion of a web or ribbon by approximately ninety degrees, and in so doing, achieve positioning of the web or ribbon in the lateral direction. The movement of the compensators 56 allows the ribbons 48 to be positioned in the longitudinal direction. After being folded, the ribbons 48 are cut into individual pages or signatures by cutting cylinders 58, under the control of a cutoff control system (not shown). It is important to maintain the proper position of the cutoff with respect to the image printed on the web.

Driven points downstream of the dryer 20 include the chill rolls 46 (the chill rolls for each web are all driven together by a single motor, not shown), a slitter roller 60, upper folder rollers 62 (eight of them shown are driven together), and the cutting cylinders 58 in the folder. The driven slitter roller 60 has an associated nip roller 61. Similarly, the upper folder rollers 62 each have an associated nip roller (not shown). The driven rollers each have an associated motor and drive for the motor (also not shown). The drives are programmed as described below.

Because of the necessary one-to-one correspondence with the printing units 44 for cutoff and numbering, the cutting cylinders 58 are run synchronously with the printing units 44. Similarly, the numbering units also run synchronously with the printing units 44. The web guide 24 and full web compensator 30 include only idler rollers rather than driven rollers.

Thus, between the chill rolls 46 and the slitter roller 60 are a plurality of idler rollers 54. Additionally, between the slitter roller 60 and the upper folder rollers 62 are a plurality of idler rollers 54. Tension monitoring transducers 66, 68 are mounted near the chill rolls 46 and near the slitter roller 60.

Figure 2:
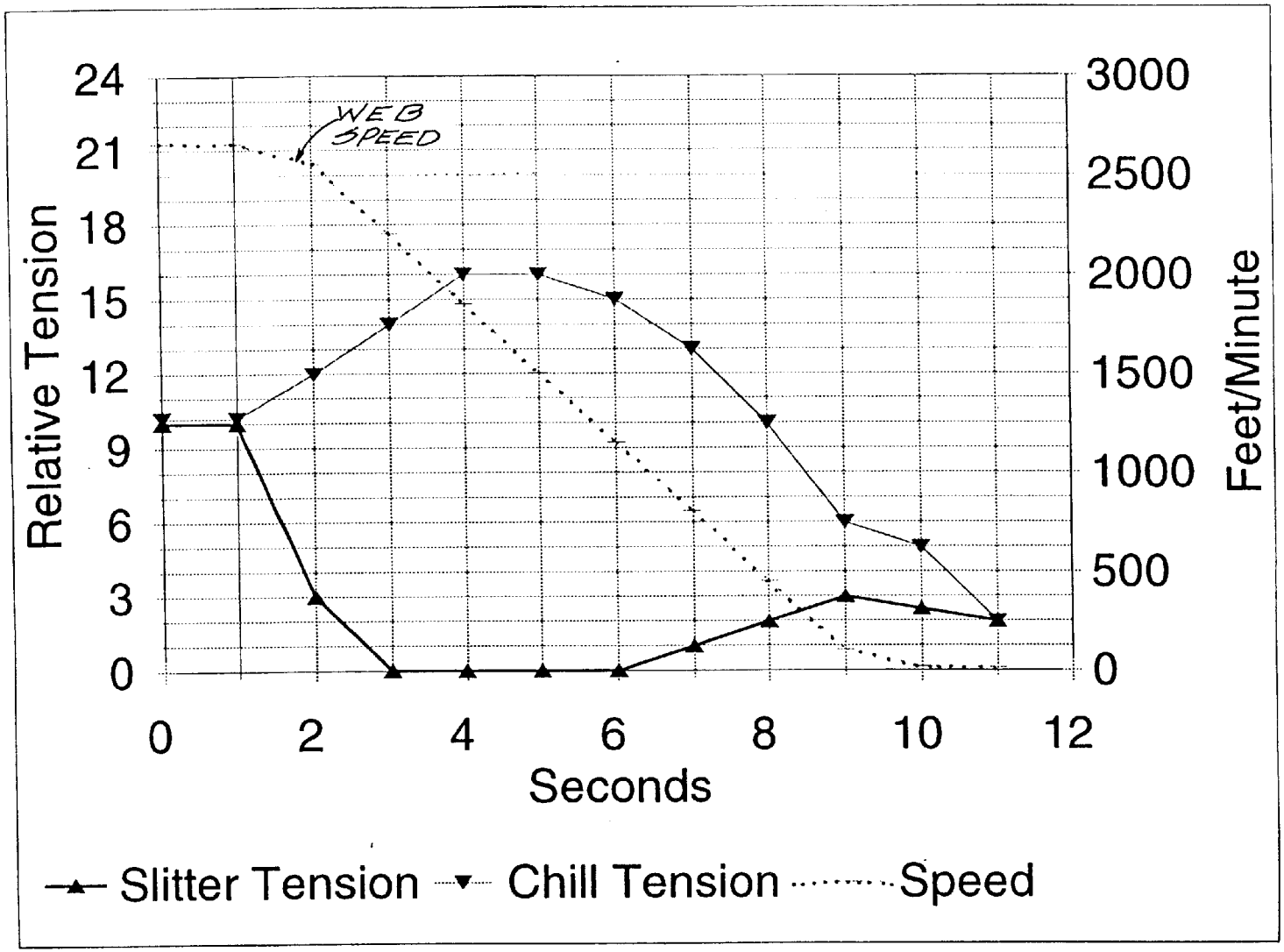
FIG. 2 is a conceptual graph of prior art web tension measured on a press during deceleration.

FIG. 2 is a graph showing the typical tension versus time of the web 40 at various points in a Heidelberg-Harris M3000 press during deceleration. Although the chill transducer 66 and the slitter transducer 68 are measuring the same web span, the inertia of the various idler rollers 54 cause the web 40 to be pulled downstream. This results in a high tension at the chill transducer 66 and a low tension at the slitter transducer 68. The low tension at the slitter 34 can cause improper slitting, with resultant web breaks and delay.

Figure 3:
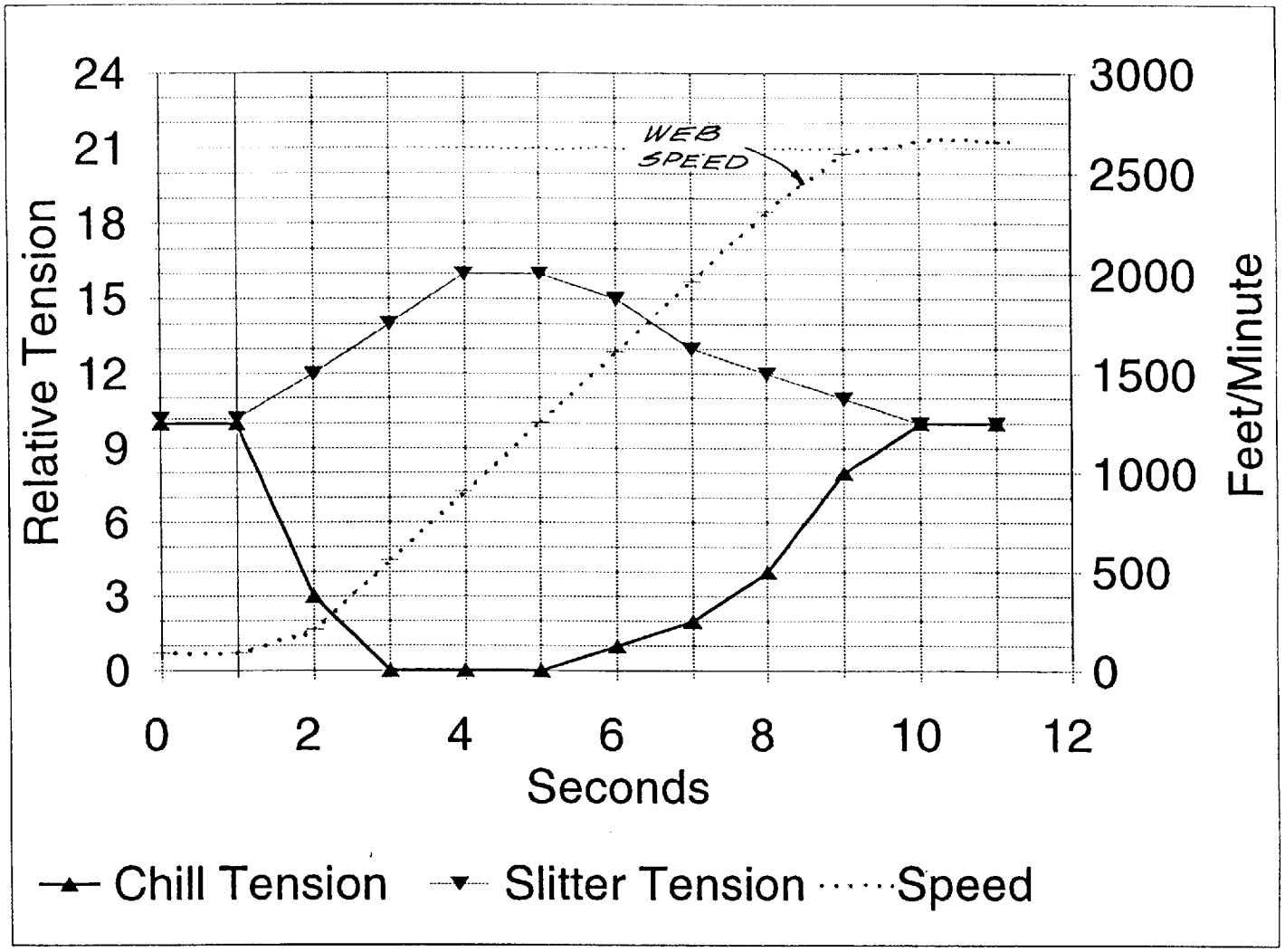
FIG. 3 is a conceptual graph of prior art web tension measured on a press during acceleration.

FIG. 3 is a graph showing the typical tension versus time of the web at various points in a Heidelberg-Harris M3000 press during acceleration. The inertia of the various idler rollers between the transducers 66 and 68 prevents the paper from being easily pulled downstream. The result is low tension at the chill transducer 66 and high tension at the slitter transducer 68. The low tension at the chill stand 22 can cause lateral shifts of the paper on the chill rolls 46, with resultant jam-ups and delay.

Turning now to the present invention, in a preferred embodiment of the invention, on any web speed change, the downstream driven rollers will advance with respect to upstream driven rollers in order to prevent slack web or low tension. The term "advance" should be differentiated from the "gain" of a roller. As used herein, the "advance" of a roller refers to an additional relative forward movement beyond what would otherwise be expected from the press speed plus the nominal gain of the driven roller. Similarly, "retard" refers to an additional relative reverse movement. In the case of a driven roller being retarded by 12 inches, for example, because of slippage, the web is retarded only by a fraction of an inch.

For example, during an emergency deceleration of the web 40, the printing units 44 will disengage from the web, so that their positions are irrelevant. With the present invention, the chill rolls 46 will retard fifteen inches, the slitter roller 60 will retard five inches, and the upper folder rollers 62 will advance three inches. During an emergency deceleration, a web severer (not shown) in the folder cuts the folded web and pushes it out the side of the folder to prevent jam-ups before that portion of the web reaches the cutting cylinders 58. Thus, the cutting cylinders 58 are bypassed, making their positions irrelevant as well. As each driven roller advances with respect to the roller upstream, low tension conditions are prevented. Because the infeed web guides 14 operate in tension control mode, the infeeds will absorb any slack web created by the retarding of the chill rolls 46.

As another example, on an acceleration during start-up, with respect to the printing units 44, the chill rolls 46 will advance three inches, the slitter roller 60 will advance five inches, and the upper folder rollers 62 will advance eight inches. As each downstream driven roller advances with respect to the driven roller upstream, low tension conditions are prevented. Because the advancement of the various rollers is countered by the inertia of the idler rollers 54, causing slippage, no excess paper is left over to form a slack web just upstream of the folder 38, which otherwise would cause jam-ups.

As a further example, on a final deceleration at the end of a job, with reference to the cutting cylinders 58, the upper folder rollers 62 will retard two inches, the slitter roller 60 will retard five inches, and the chill rolls 46 will retard eight inches. Because the printing units 44 are typically undergoing a blanket wash concurrent with the deceleration, they are highly lubricated, allowing web slippage, and making their positions generally irrelevant. As each driven roller advances with respect to the driven roller upstream (equivalent to retarding with respect to the roller downstream), low tension conditions are prevented.

Figure 4:
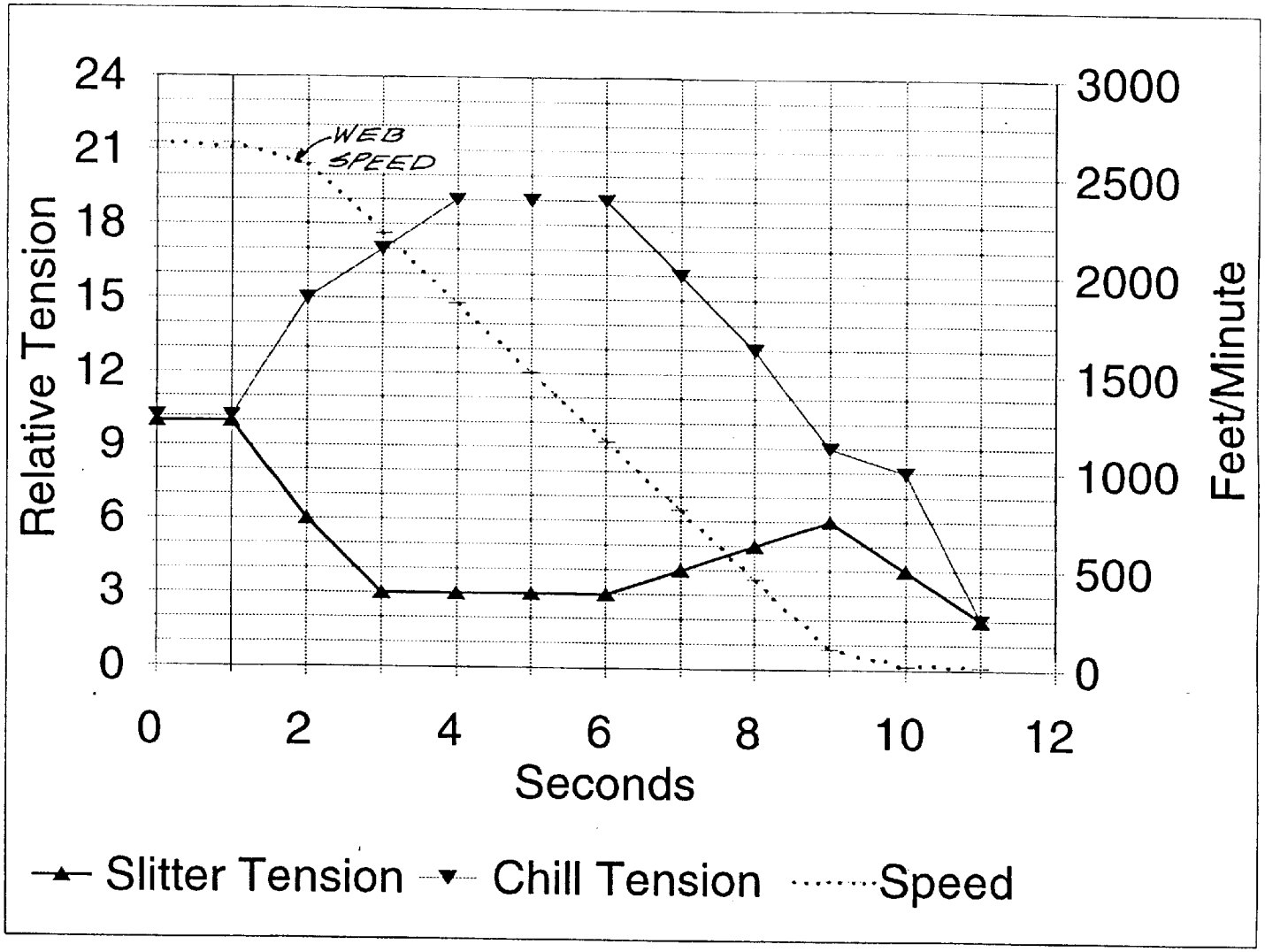
FIG. 4 is a conceptual graph of web tension measured on a press during deceleration using the present invention.

FIG. 4 is a conceptual graph of tension measured on a Heidelberg-Harris M3000 press during deceleration wherein the driven rollers are controlled pursuant to the present invention. Advancing the slitter roller 60 approximately three inches with respect to the chill rolls 46 produces higher tension at the slitter 34, as compared to that shown in FIG. 2. This higher tension at the slitter 34 prevents web failure.

Figure 5:
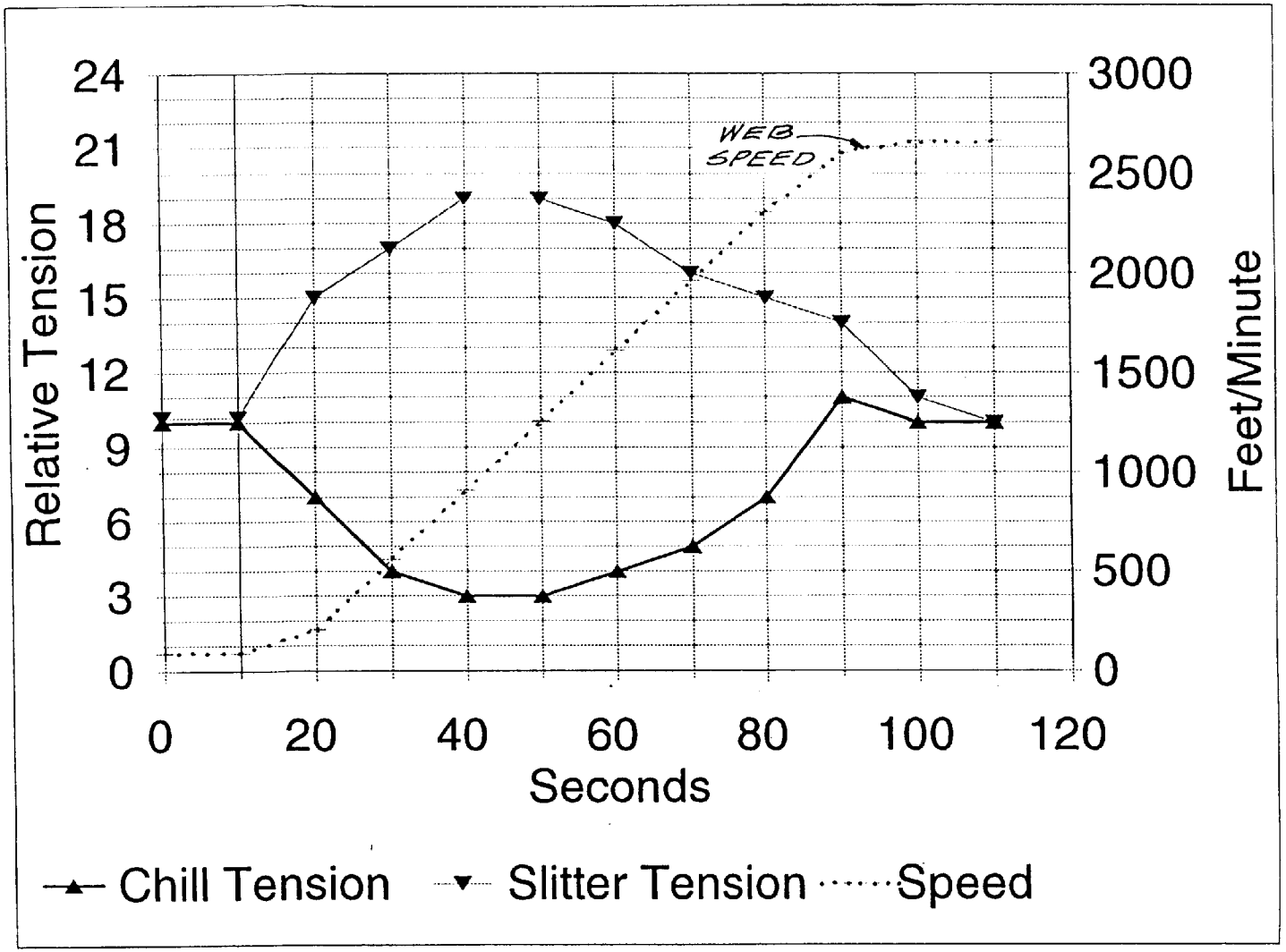
FIG. 5 is a conceptual graph of web tension measured on a press during acceleration using the present invention.

FIG. 5 is a conceptual graph of tension measured on a Heidelberg-Harris M3000 press during acceleration wherein the driven rollers are controlled pursuant to the present invention. Advancing the slitter roller 60 by approximately three inches with respect to the chill rolls 46 produces higher tension at the chill rolls 46, preventing the lateral shift of the web 40 in the dryer 20.

Figure 6:
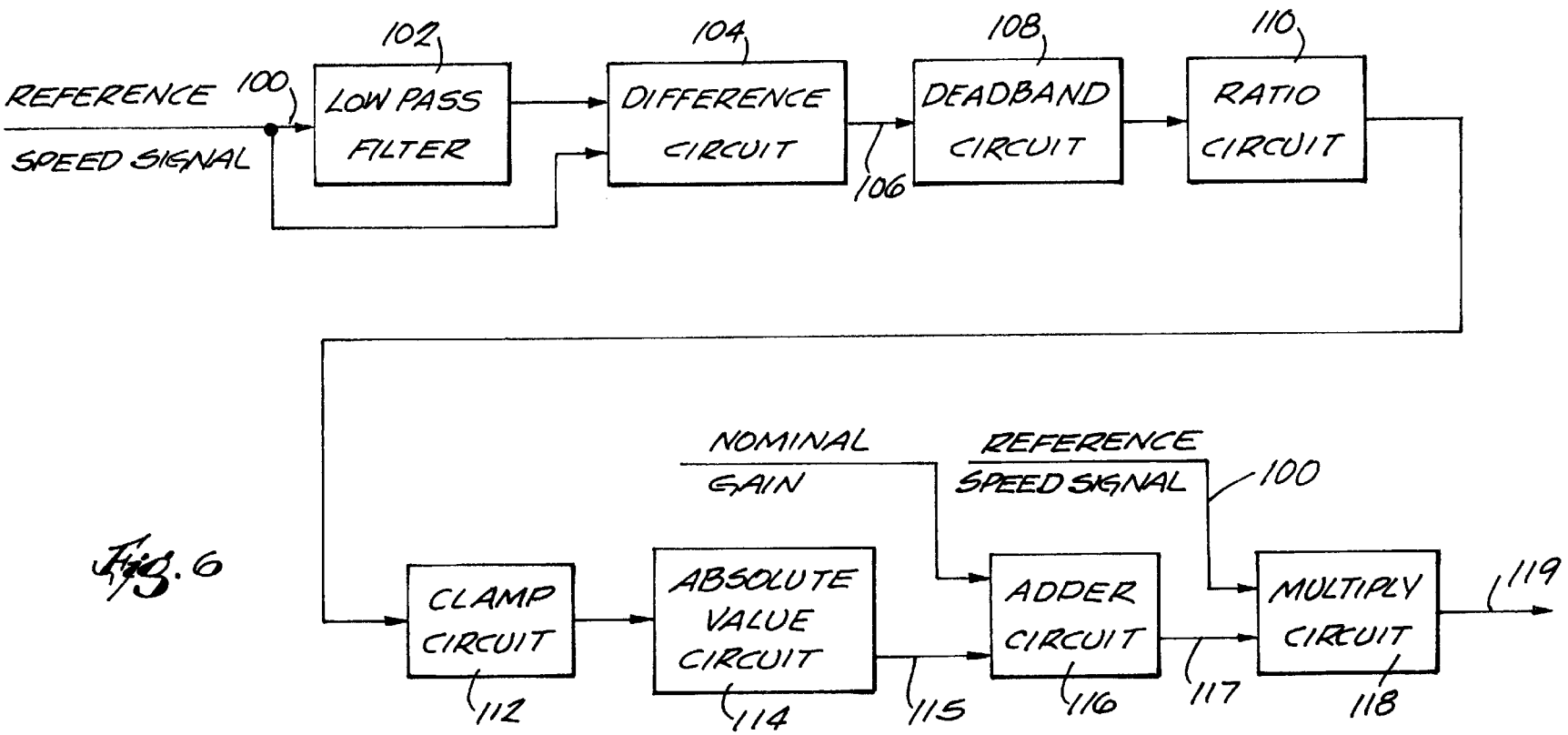
FIG. 6 illustrates the operation of a drive controller to control web tension during speed changes, using the present invention.

Referring now to FIG. 6, the apparatus and method of causing roller advancement during changes in web speed will be described. In the preferred embodiment, the drives are GE DC2000 drives available from General Electric. The overall control method used is that of a conventional "virtual master" speed reference. A press-wide reference speed signal 100 indicative of web speed is transmitted to all the motor drives. The various driven rollers follow the speed reference, after adding the desired amount of gain. During a speed change, the drives are programmed to advance or retard their respective driven roller as required.

In particular, the drives are programmed to detect a speed change. In order to detect a speed change, (i.e., an acceleration of the web) the reference speed signal 100 is fed to both a low pass filter 102 and a difference circuit 104. The low pass filter 102 introduces a signal delay to the reference speed signal 100. The difference circuit 104 subtracts the delayed reference speed signal from the non-delayed reference speed signal 100. The output of the difference circuit 104 yields a signal 106 indicative of the acceleration of the web 40. The acceleration signal 106 is deadbanded in circuit 108 to eliminate flutter due to slight signal variations during steady run. The output of circuit 108 is then scaled in ratio circuit 110, and limited to predetermined maximum and minimum limits in clamp circuit 112. The limited signal from clamp circuit 112 is translated to motor advancement values by an absolute value circuit 114 and the result is added to the nominal gain of the drive in adder circuit 116. Output 115 of circuit 114 represents the advance/retard signal. Output 117 of adder circuit 116, representing a modified gain, is multiplied in circuit 118 by speed signal 100 to yield motor speed signal 119.

Figure 8:
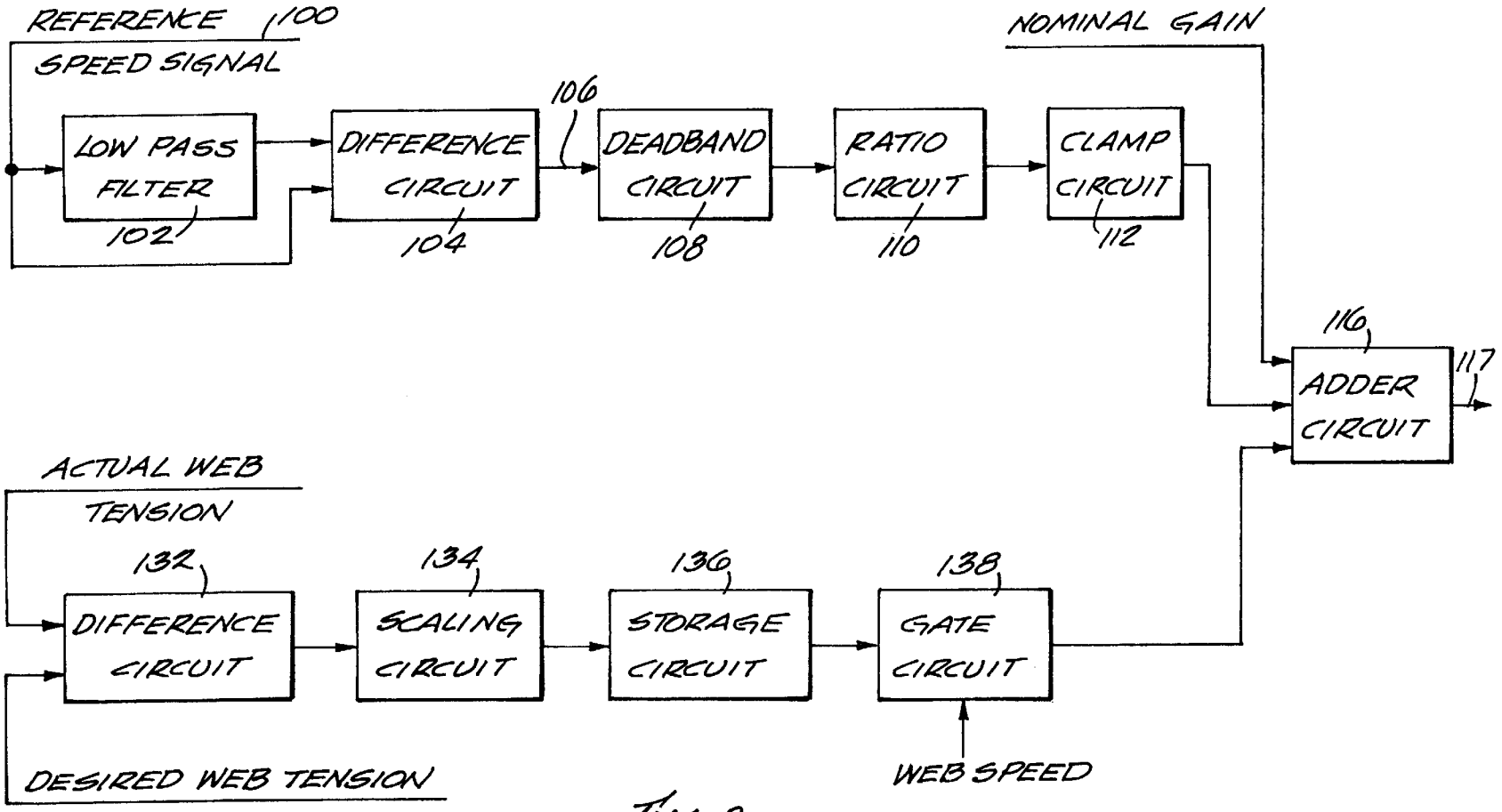
FIG. 8 illustrates the operation of a drive controller controlling a chill roll to control tension during startup.

As illustrated in FIG. 8, note that the drives associated with the chill rolls 46 do not include an absolute value circuit 114, because a retarding rather than advancing of the chill rolls 46 is desired upon the deceleration of the web.

On a press startup, the advancement value is chosen to compensate for the drag of the idler rollers 54. Thus, the maximum limit for the clamp circuit 112 is empirically chosen such that the advancement of the rollers nulls the drag of the idler rollers 54, and proper cutoff of the individual signatures is established immediately upon startup.

Because a plurality of independently driven rollers may be used in a printing press line, the minimum and maximum limits in the clamp circuit 112 are chosen to provide progressively wider ranges for the drives which are associated with driven rollers that are progressively further downstream in the press line. This maintains tension on the web despite the inertia of the idler rollers. For example, the minimum limit and maximum limit are typically −6 and 6 respectively for the chill rolls, −9 and 12 respectively for the slitter roller, and −12 and 15 respectively for the upper folder rollers.

The drives are typically tuned during installation to correctly react to the inertial load of their associated roller. However, this tuning is unrealistic of normal press operating conditions. During normal operating conditions, a driven roller is also inertially coupled through the web 40 to the nearby idler rollers 54, substantially increasing the effective inertia seen by the drive. Because the drive is coupled to a much larger load than the drive is tuned for, the roller will react sluggishly to variations in load. If the inertial settings are manually increased to a value typical of running conditions, the driven roller will overreact and chatter when a web is absent or slack, or at low speeds such as during make ready. Such chatter can lead to wear and breakage of the motor or couplings.

Because the drive response in the prior art is optimized for a lower inertia than that existing under running conditions, web movement is instead altered by variations in tension, an undesirable condition. This problem is particularly undesirable in low-inertia components such as a slitter, which consists of only a driven roller 60 and nip roller 61. A high-inertia device such as a chill stand 22, which consists of multiple large rollers, is only minimally affected by changes in inertial loading.

Another aspect of the present invention is to provide inertial setting changes for the drives during changes in press conditions. As an example, during a speed or tension change, the slitter roller drive is programmed to change its inertial load setting under various operating conditions.

Figure 7:
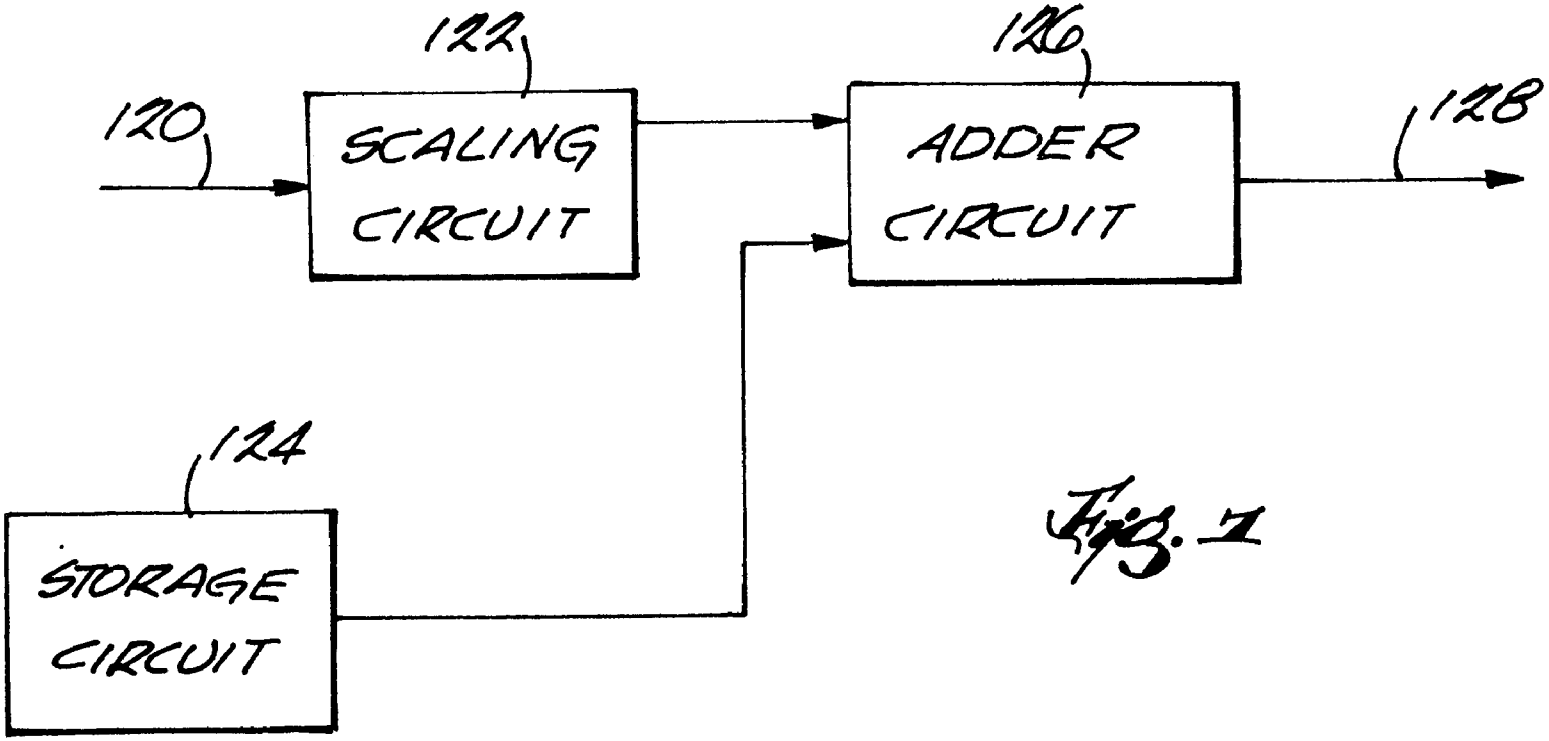
FIG. 7 illustrates the operation of a drive controller for providing inertial setting changes for the slitter drive during changes in press conditions.

In particular, to compensate for increased inertial loading as the normal web tension is achieved, inertial compensation is increased as web tension is applied. Referring to FIG. 7, signal 120 is a voltage signal representing web tension measured near the slitter. This voltage signal may be derived from transducers 66,68 mounted on idler rollers 54 and amplified by a tension measurement amplifier (not shown). For example, such a tension measurement amplifier is available as part number TI-4, and transducers 66, 68 are available as part number series TR, both from Dover Flexo Electronics of Rochester, NH. The web tension signal 120 is scaled in circuit 122, and added in adder circuit 126 to an offset from circuit 124 representing the resting inertia. The resultant signal 128 is used as the drive's inertial compensation setting. As embodied on a GE DC2000 drive, the voltage is input on terminal P4 represented by about 0.02 Volts per pound of tension with the P4 input potentiometer set about halfscale.

The tension of the web may not be conveniently available at the point where a drive is physically placed in a press. In this situation, voltage signal 120 may be replaced by a signal indicative of the speed of the web 40. Because a slack web generally only occurs during stoppage or crawl-speed situations, the speed-related signal can be substituted for the tension signal 120.

In another aspect of the invention, a drive is programmed to provide tension control during start up. As an example, the drive for the chill roll 46 is so programmed until the slitter 34 is engaged. Proper tension control during the startup of a press is highly desirable to avoid wrinkling of the web 40 or a slack web with resultant lateral instability. At low speeds, the nip roller 61 adjacent driven slitter roller 60 is typically disengaged, so that tension correction at the slitter drive is ineffective. Web tension downstream of the chill rolls is initially low, which tends to cause lateral instability, wrinkling of the web, and poor slitting, leading to web-breaks on startup. If the web is run at slow speed for a long period of time, the web tension downstream of the chill rolls gradually increases. This characteristic can be advantageously used by the press operator to achieve needed tension, but requires several minutes of valuable time. After too much time, the web will reach an excess tension, risking breakage of the web.

In this situation, the present invention allows the chill roll drive to provide tension control until the slitter nip roller 61 is engaged. Varying the gain of the chill roll drive to achieve tension control is known in the art; for example, the Quad/Tech Chill Roll 2000, manufactured by the assignee of the present invention, has the option of tension control. Correction of high tension downstream of the chill rolls is performed by advancing the chill rolls 46. Because high tension causes an advancement of the image at the cutoff, further advancement exacerbates rather than corrects the cutoff error. The present invention provides for tension control without degradation of cutoff accuracy by discontinuing tension control at the chill rolls 46 when the press achieves such speed that the slitter nip roller 61 becomes engaged. Because the slitter nip roller 61 becomes engaged below the speed at which savable product is produced, no additional product is degraded.

To accomplish this aspect of the invention, and with reference to FIG. 8, difference circuit 132 compares the actual web tension with the desired web tension at startup. The tension error signal is then multiplied in scaling circuit 134 to produce a gain correction factor stored in storage circuit 136. Data gate circuit 138 allows the gain correction factor to pass through when the press speed is within a predetermined window. For example, in the preferred embodiment, the predetermined window is between 60 and 500 fpm. The high limit of the pass-through window is chosen to discontinue tension control when the slitter nip roller 61 is engaged, whereupon the slitter drive performs tension control at normal press running speeds. The gain correction factor, if passed through, is added to the nominal gain of the chill rolls in adder circuit 116. Typically, during initial crawl of a press on startup, web 40 has very low tension, and chill gain drops from a nominal 0.3% to approximately 0.1%. The chill rolls 46 will typically retard one to two inches until desired web tension is reached, generally within 30 seconds. Because at crawl speed, the printing units 44 are not yet engaged, the excess slack is absorbed by the infeed web guide 14. Because the time required for tension achievement is less than the time needed for the dryer 20 to reach full operating temperature, no additional time is wasted.

An additional benefit of this aspect of the invention is realized in the case of a double web operation. If at low speed, the tensions of the upper and lower webs differ significantly, the slack web tends to be dragged backwards by the tighter web at the former board 50 of the folder 38, which is the initial point of contact between the webs. This backwards dragging causes further tension loss with wrinkling and risk of jam-ups. With the invention practiced on both webs, dragging of a web is minimized.

Figure 9:
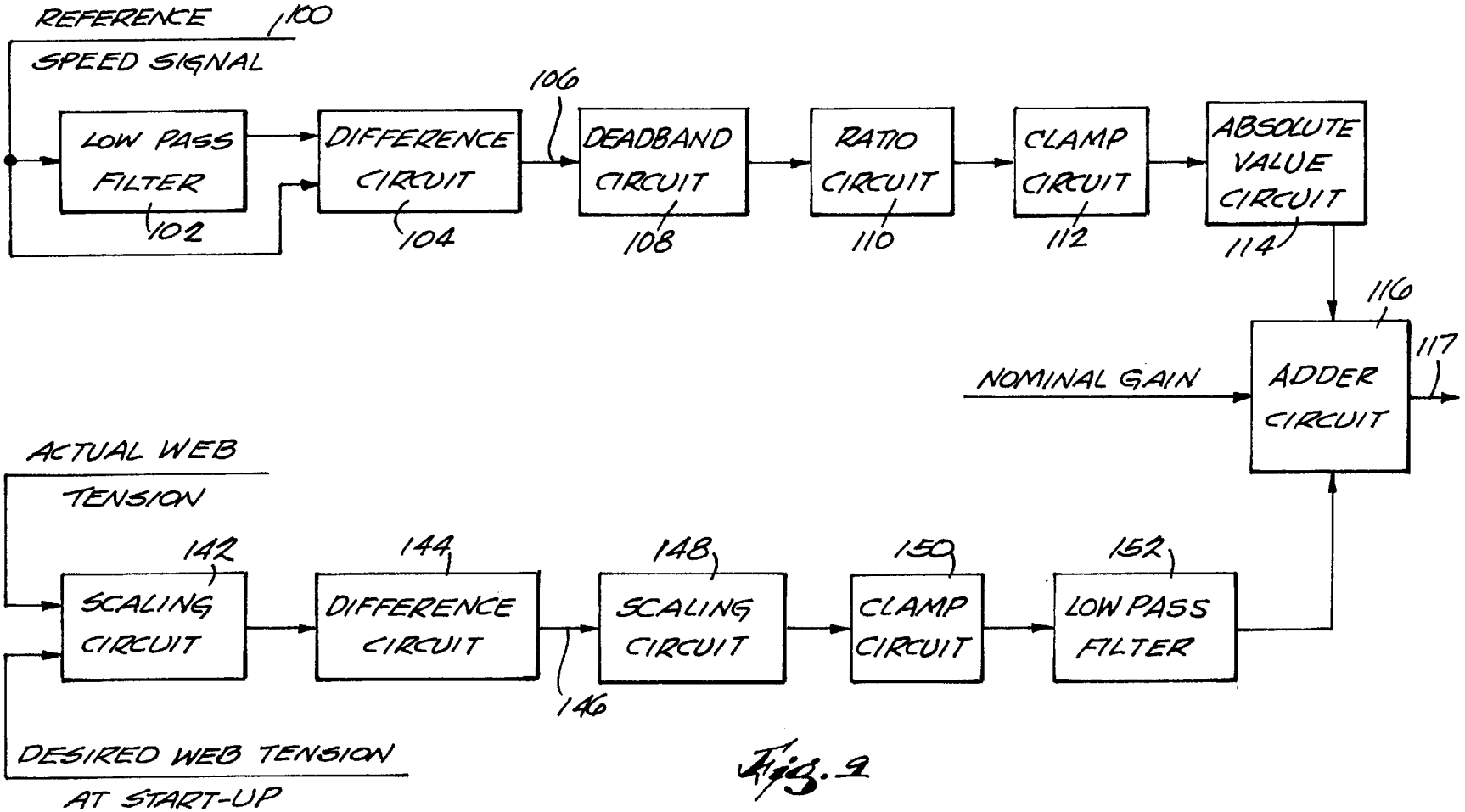
FIG. 9 illustrates the operation of a drive controller controlling the slitter roller during a splice.

In another aspect of the present invention, the advancement of cutoff position caused by tension increases after splices is minimized by a method of partial tension control of the web upstream of the slitter 34 at the slitter roller 60. Referring to FIG. 9, scaling circuit 142 scales the desired tension by a specified scaling factor. Next, difference circuit 144 subtracts the actual tension from a constant representing the scaled desired tension. The resultant tension error signal 146 is scaled in circuit 148, clamped in circuit 150, then filtered in low pass filter 152. The output of filter 152 is added to the nominal gain of the drive in adder circuit 116. Thus, after a splice, high tension results in a negative amount being added to the nominal gain, resulting in a retarding of the slitter roller 60 with subsequent tension decrease in the web upstream of the slitter 34. This tension decrease shrinks the web and compensates for the stretching of the web downstream of the slitter 34. Scaling circuit 148 is set to a gain which results in only an approximate 50% control of tension variations as compared to tension variations with the invention; full tension control will overcompensate for cutoff error during splices of the web, resulting in a retarding rather than advancing of the cutoff. The scaling divisor in scaling circuit 148 is empirically chosen to null cutoff error: an excessively large divisor will produce inadequate control, leading to a cutoff advance during splices and an excessively small divisor will produce excess control and retarding of cutoff on splice. Such empirical nulling may be accomplished either by adjusting the input potentiometer P4, or by adjusting the divisor in circuit 148.

The microfiche appendix includes the source code listing for the present embodiment of programming (computer program) which configures the GE DC2000 drives to operate as circuits 102, 104, 108, 110, 112, 114, 116, 118, 122, 124, 126, 132, 134, 136, 138, 142, 144, 148, 150 and 152.

It is to be understood that the invention is not confined to the particular construction and arrangement of parts herein illustrated and described, but embraces all such modified forms thereof as may come within the scope of the following claims. It will be apparent that many modifications and variations are possible in light of the above teachings. Therefore, it is to be understood that within the scope of the appended claims, the invention may be practiced other than is specifically described. Alternative embodiments and variations of the method taught in the present specification may suggest themselves to those skilled in the art upon reading of the above description. In particular, the example of a press running a single web has been used for clarity, but the invention pertains to a multi-web press as well. Also, the press line itself can include different or fewer modules than the embodiment described. Further, the preferred embodiment describes a shaftless press, however, the claim should not be construed to be limited to shaftless presses. Control of harmonic motors on a shafted press would accomplish the same objective in the same manner. Although the described embodiment includes a printing press utilizing a folder having a former board, the invention is equally applicable to presses with other post-press equipment such as a combination folder, sheeter, or rewinder, as are well known in the art.

What is claimed is:

1. A method for preventing low tension on a web travelling from upstream to downstream in a web-offset printing press line, the method comprising the steps:

detecting a speed change of the web;

advancing a first downstream web-contacting driven roller by a predetermined amount with respect to a second upstream web-contacting driven roller in response to the speed change of the web; and advancing a third, furthest downstream web-contacting driven roller by a predetermined amount with respect to the first downstream driven roller in response to the speed change of the web, wherein the roller advancement of the third driven roller is greater than the roller advancement of the first driven roller.

2. The method of claim 1 wherein the step of detecting a speed change includes low pass filtering a signal indicative of web speed.

3. A method for preventing low tension on a web travelling from upstream to downstream in a web-offset printing press line the method comprising the steps:

detecting a speed change of the web;

advancing a first downstream web-contacting driven roller by a predetermined amount with respect to a second upstream web-contacting driven roller in response to the speed change of the web; and wherein the first downstream driven roller has an associated gain with respect to the speed of the web, the method including the further step of stabilizing the gain of the first downstream driven roller by changing the inertial setting of an associated drive in response to the speed change of the web.

4. A method for preventing low tension on a web travelling from upstream to downstream in a web-offset printing press line, the method comprising the steps:

detecting a speed change of the web;

advancing a first downstream web-contacting driven roller by a predetermined amount with respect to a second upstream web-contacting driven roller in response to the speed change of the web; and wherein the first downstream driven roller has an associated gain with respect to the speed of the web, the method including the further step of stabilizing the gain of the first downstream driven roller by increasing the inertial setting of an associated drive in response to a speed increase of the web.

5. A method for preventing low tension on a web travelling from upstream to downstream in a web-offset printing press line, the method comprising the steps:

detecting a speed change of the web;

advancing a first downstream web-contacting, driven roller by a predetermined amount with respect to a second upstream web-contacting driven roller in response to the speed change of the web; and wherein the first downstream driven roller has an associated gain with respect to the speed of the web, the method including the further step of stabilizing the gain of the first downstream driven roller by decreasing the inertial setting of an associated drive in response to a speed decrease of the web.

6. A method for preventing low tension on a web travelling from upstream to downstream in a web-offset printing press line, the method comprising the steps:

detecting a speed change of the web;

advancing a first downstream web-contacting driven roller by a predetermined amount with respect to a second upstream web-contacting driven roller in response to the speed change of the web; and wherein the first downstream driven roller has an associated gain with respect to the speed of the web, the method including the further step of measuring the web tension and stabilizing the gain of the first downstream driven roller by changing the inertial setting of an associated drive when the measured web tension changes.

7. A method for preventing low tension on a web travelling from upstream to downstream in a web-offset printing press line, the method comprising the steps:

detecting a speed change of the web;

advancing a first downstream web-contacting driven roller by a predetermined amount with respect to a second upstream web-contacting driven roller in response to the speed change of the web; and wherein the first downstream driven roller has an associated gain with respect to the speed of the web, the method including the further step of measuring the web tension and stabilizing the gain of the first downstream driven roller by increasing the inertial setting of an associated drive when the measured web tension increases.

8. A method for preventing low tension on a web travelling from upstream to downstream in a web-offset printing press line, the method comprising the steps:

detecting a speed chance of the web;

advancing a first downstream web-contacting driven roller by a predetermined amount with respect to a second upstream web-contacting driven roller in response to the speed change of the web; and wherein the first downstream driven roller has an associated gain with respect to the speed of the web, the method including the further step of measuring the web tension and stabilizing the gain of the first downstream driven roller by decreasing the inertial setting of an associated drive when the measured web tension decreases.

9. A system for preventing low tension on a web travelling from upstream to downstream in a web-offset printing press line, the system comprising:

an upstream driven roller in contact with a web;

a downstream driven roller in contact with the web;

a motor drive controller in communication with the downstream driven roller, the controller programmed to detect a speed change of the web, and in response to the detected speed chance, advance the downstream driven roller with respect to the upstream driven roller; and wherein the downstream driven roller has an associated gain with respect to the speed of the web and the controller is programmed to stabilize the gain of the downstream driven roller by changing the inertial setting in response to a speed change of the web.

10. The system of claim 9 wherein the change of the inertial setting is an increase and the speed change of the web is an increase.

11. The system of claim 9 wherein the change of the inertial setting is a decrease and the speed change of the web is a decrease.

12. A system for preventing low tension on a web travelling from upstream to downstream in a web-offset printing press line, the system comprising:

an upstream driven roller in contact with a web;

a downstream driven roller in contact with the web;

a motor drive controller in communication with the downstream driven roller, the controller programmed to detect a speed change of the web, and in response to the detected speed change, advance the downstream driven roller with respect to the upstream driven roller; and further including a transducer located near the downstream driven roller to measure web tension of the web and wherein the downstream driven roller has an associated gain with respect to the speed of the web and the controller is programmed to stabilize the gain of the downstream driven roller by changing the inertial setting in response to a change in the transducer measured web tension.

13. The system of claim 12 wherein the inertial setting is increased in response to an increase in web tension.

14. The system of claim 12 wherein the inertial setting is decreased in response to a decrease in web tension.

15. A method for stabilizing the gain of a driven roller in the path of a web travelling in a web-offset printing press line, the method comprising the steps:

measuring the tension of the web; and increasing the inertial setting of a motor drive controller operably connected to the driven roller when the tension of the web increases.

16. The method of claim 15 wherein the driven roller is a slitter roller.

17. A method for stabilizing the gain of a driven roller in the path of a web travelling in a web-offset printing press line, the method comprising the steps:

measuring the speed of the web; and increasing the inertial setting of a motor drive controller operably connected to the driven roller when the speed of the web increases.

18. The method of claim 17 wherein the driven roller is a slitter roller.

19. A method for stabilizing the cutoff of a web in a web-offset printing press line after a splice, the web travelling from upstream to downstream, the method comprising the steps:

measuring the tension of the web at a location upstream of an adjustably driven roller in contact with the web;

comparing the tension to a desired tension to obtain a tension error; and summing a desired gain of the driven roller in contact with the web with the tension error to obtain a modified gain, such that the modified gain partially corrects for a portion of the tension error.

20. The method of claim 19 wherein the driven roller is a chill roll.

21. The method of claim 19 wherein the partial correction is approximately 50%.

22. A method for stabilizing the tension of a web traveling from upstream to downstream in a web-offset printing press line during startup, the method comprising the steps:

measuring the tension of the web at a location downstream of an adjustably driven chill roll;

comparing the tension to a desired tension to yield a tension error;

summing a desired gain of the chill roll with the tension error to obtain a modified gain, such that the modified gain corrects for the tension error; and ceasing said modification of the desired gain at the speed above which printing is initiated.

23. An apparatus for stabilizing the gain of a driven roller in the path of a web travelling in a web-offset printing press line, the apparatus comprising:

a transducer for measuring the tension of the web; and a motor drive controller adapted to be operably connected to the driven roller, the controller programmed so as to increase the inertial setting when the tension of the web increases.

24. An apparatus for stabilizing the gain of a driven roller in the path of a web travelling in a web-offset printing press line, the apparatus comprising:

a transducer for measuring the speed of the web; and a motor drive controller adapted to be operably connected to the driven roller, the controller programmed to increase the inertial setting when the speed of the web increases.

* * * * *